United States Patent [19]

Ness

[11] 4,273,299

[45] Jun. 16, 1981

[54] HOLDER FOR ROLLS OF PAPER

[76] Inventor: Virginia V. Ness, P.O. Box 1078, Ross, Calif. 94957

[21] Appl. No.: 138,149

[22] Filed: Apr. 7, 1980

[51] Int. Cl.[3] ..... B65H 19/00

[52] U.S. Cl. ..... 242/55.54; 242/55.2

[58] Field of Search ..... 242/55.54, 55.53, 55.2, 242/55.3; 211/6, 16

[56] References Cited

U.S. PATENT DOCUMENTS

| | | | |
|---|---|---|---|
| 2,523,951 | 9/1950 | Graumlich | 242/55.54 |
| 2,928,618 | 3/1960 | Locke | 242/55.54 |
| 3,329,366 | 7/1967 | Batlas | 242/55.53 |
| 3,539,124 | 11/1970 | Belokin | 242/55.54 |
| 3,806,057 | 4/1974 | Whatley | 242/55.54 |
| 4,074,872 | 2/1978 | Marshall | 242/55.54 |

*Primary Examiner*—Edward J. McCarthy

*Attorney, Agent, or Firm*—Owen, Wickersham & Erickson

[57] ABSTRACT

A holder for a paper towel roll or toilet paper roll. A stationary base member has an annular flat rim surrounding a central frustoconical projection. A rotatable member also has an annular flat rim surrounding a central hollow frustoconical projection that nests around the projection of the base member and is rotatable with respect thereto. The facing flat surfaces of the rim and the facing surfaces of the projections enable relative rotation with some resistance, to provide braking action. The outer surface of the frustoconical projection of the rotatable member includes, as integral parts thereof, a series of yieldable projections for firmly non-rotatably engaging the hollow core of a paper towel roll or toilet paper roll. The base member is secured horizontally, so that the rotatable member stands up vertically and holds the paper roll vertically.

9 Claims, 9 Drawing Figures

HOLDER FOR ROLLS OF PAPER

BACKGROUND OF THE INVENTION

This invention relates to a holder for a roll of paper, such as a paper towel roll or a toilet paper roll, by which the roll is held vertically.

Current paper towel holders are in many instances unsatisfactory. They hold the roll horizontally and in order to do so are secured to a wall or other similar surface. Often, this means that they cannot be placed closely adjacent the place where they are needed. Many such devices are also inconvenient in that they require two-hand operation. Some holders fail to hold the paper rolls snugly enough, so that the rolls tend to fall out.

An important object of the present invention is to provide a holder for paper towels which can be held by any suitable horizontal or vertical surface and which holds the paper towel roll vertically. Such a device enables easy one-hand operation and is adaptable for many locations where horizontally-held rolls are not conveniently supported.

Another object of the invention is to provide a paper roll holder in which the roll is very easily installed and removed. Both paper towels and toilet paper, when held horizontally, normally require an installation which is somewhat time-consuming and sometimes very much so. In the present invention, installation is a matter of two or three seconds and the removal takes even less than that.

The invention may be considered as an improvement over the roll-paper holder shown and claimed in my pending U.S. patent application, Ser. No. 49,235, filed June 18, 1979.

The present invention enables the user to have the paper roll bottom on the flange of the upper member in every instance, while providing yieldable but nonetheless positive holding means for engaging the core of the paper roll.

Other objects and advantages of the invention will appear from the following description of a preferred embodiment.

SUMMARY OF THE INVENTION

The invention comprises a paper roll holder made in two major elements. A stationary base member is provided having an annular horizontal rim and a central, preferably frustoconical, upwardly-extending projection. The projection need not necessarily always be frustoconical for this base member, but that is convenient. The surfaces of the rim are preferably flat and relatively smooth. Suitable securing means are attached which may be screws or ordinary adhesive, but preferably comprises a double-faced adhesive disc secured to the lower surface of the base rim with an adherent surface enabling its rapid attachment to a countertop. This adhesive surface may, of course, be covered with wax or treated paper or other similar material to enable handling prior to attachment. Alternatively, the base member may have a vertical securing portion for attachment to a vertical wall, with an horizontal shelf member from which the projection extends up vertically.

The other primary element of the device is a rotatable member having an annular rim much like that of the base member and with a smooth flat surface, usually in contact with the upper smooth surface of the rim of the base member. The rotatable member has a central hollow frustoconical projection, or at least a projection that is frustoconical on its outer surface. This projection nests around the projection of the base member and is freely rotatable with respect to it, the facing surfaces being quite smooth and presenting sufficiently low friction to each other to enable relative rotation with some resistance that applies a braking action. The outer surface of the frustoconical projection includes a series of yieldable members that are an integral part of the projection, and they firmly and non-rotatably engage a hollow core of a paper towel roll or roll of toilet paper. These members may comprise small projections, which may be shaped like teardrops, that are mostly free from the projection except for a springy connecting portion at their upper edges; they normally extend radially outwardly, but yield readily to deflection radially inwardly, into the openings made around their edges.

Thus, the base member can be adhesively secured (or secured otherwise, if desired) to a stationary horizontal supporting surface such as a countertop, or it may be secured to a wall and have an horizontal shelf portion. The base member is then stationary. The rotatable member, which is freely removable from the base member, is easily stuck into one end of the core of a paper towel roll or toilet paper roll, the holding projections yielding to such insertion, so that the paper roll rests against the annular rim, the projections then being urged by a light spring force to engage and hold the core. The rotatable member may then be placed back over the base member. If desired, it need not even be removed, the old paper core being readily lifted off, torn off, or stripped from the projections and the new one forced down on top of it. When installed, the roll of paper and the rotatable upper member move together around the base, and it is easy to pull off one or more paper towels or sheets of toilet paper with one hand.

DESCRIPTION OF PREFERRED EMBODIMENTS

Figure 2:
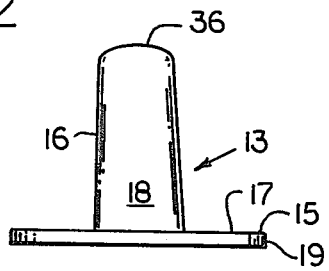
FIG. 2 is a view in side elevation of the base member alone.
Figure 1:
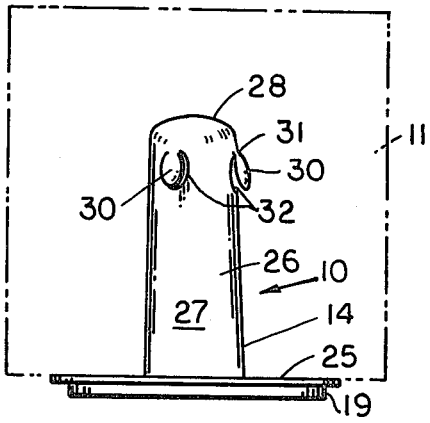
FIG. 1 is a view in side elevation of an assembly of the present invention with an installed roll of paper shown in broken lines around it.
Figure 3:
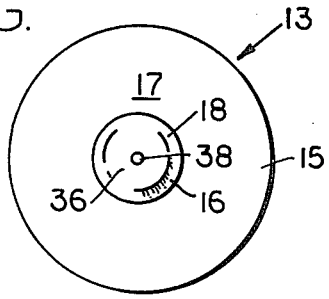
FIG. 3 is a top plan view of the base member.
Figure 4:
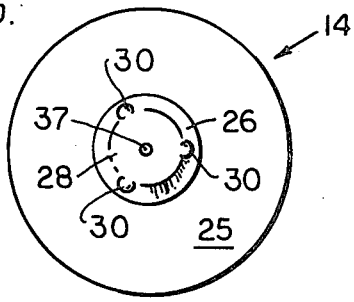
FIG. 4 is a top plan view of the rotatable member.
Figure 5:
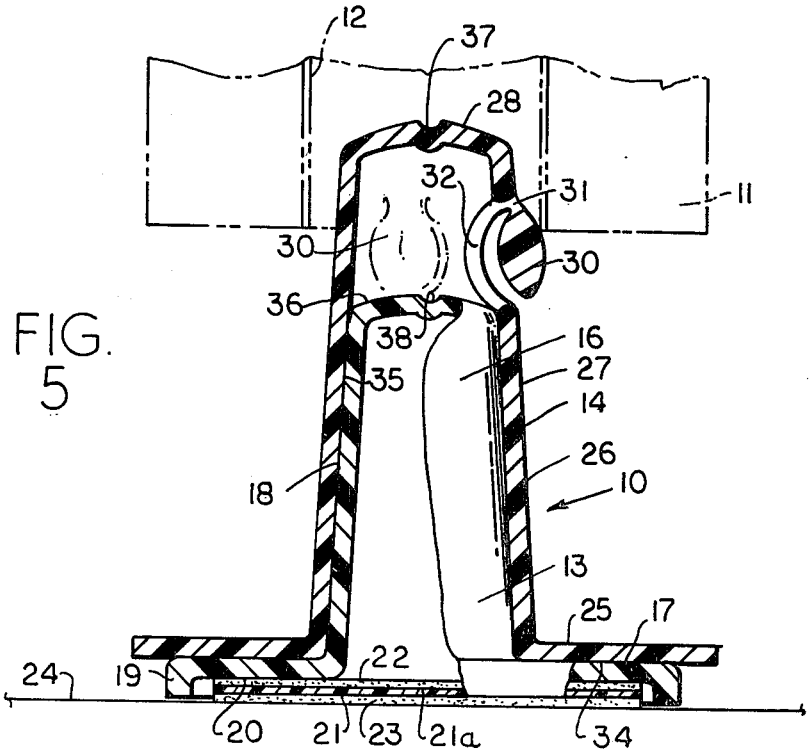
FIG. 5 is an enlarged view partly in section of the assembly secured to a countertop, with a portion of the supported roll shown in broken lines as it is being installed.
Figure 6:
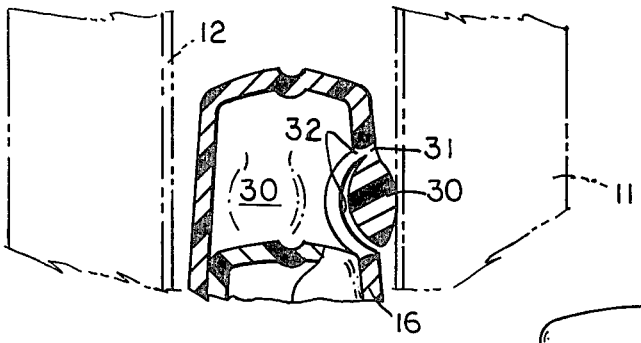
FIG. 6 is a similar view of the top portion after installation.

The Embodiment of FIGS. 1-6:

FIGS. 1 to 6 show a plastic paper-roll holder 10 which can hold vertically either a roll 11 of paper towels or a roll of bathroom toilet tissues, the roll 11 having a cylindrical hollow cardboard core 12 (FIG. 5). A preferred plastic is high-impact polystyrene.

The holder 10 comprises two main members, namely, a stationary plastic base 13 and a rotatable upper plastic paper-holding member 14.

The base 13 comprises a generally flat circular plastic annulus or rim 15, preferably about 1/12 inch thick, and a central protrusion 16 which may, for example, be about 1¼ inch in diameter, about 1/12 inch thick, and extend about 2¼ inches high. The base 13 is provided so that both the upper surface 17, of the rim 15 and the outer surface 18 of the protrusion 16, present low enough friction to enable rotation of the upper member 14, but enough friction to apply some braking action. Instead of being smooth, as shown, there may be one or more circumferential ribs, if desired, to help in achieving this controlled rotary motion, with braking, but with many plastics this is achieved with smooth surfaces, as it is with high-impact polystyrene. Thus, the upper surface 17 of the rim 15 and the surface 18 of the protrusion 16 provide surfaces of which the member 14 can freely rotate with some braking. Preferably, the protrusion 16 is frustoconical, at an angle of about 1° or 2°, e.g., 1°20′.

Preferably, the rim 15 has a downwardly extending outer circumferential lip 19, and a lower surface 20 of the rim 15 has a disc 21 (preferably three inches in diameter) of two-way adhesive secured to it. This disc 21 is preferably made of a sheet **21*a* of 1/16″ white plastic foam (e.g., polyethylene) coated on both sides with strong adhesive 22, 23; it may come as a separate element when sold, with wax or treated paper covering the surface of both its upper adhesive layer 22 and its lower adhesive layer 23, or the upper adhesive layer 22 may be adhered prior to sale to the bottom surface 20 of the rim 15. The foam 21*a* provides a desired resiliency, withstanding shock, and also enables clean removal from a counter, by forcing a blunt knife into the foam and liftng up the base 13; the foam 21*a* is then sheared apart, and the adhesive 23 and the foam portion remaining with that are readily removed by a solvent, such as alcohol. In place of this convenient adhesive disc 21, which is preferably slightly thicker than the lip 19, e.g., 1/16″ for a lip thickness of about 1/20 inch, the device may be supplied without such a disc, and the user may either apply adhesive such as cement or may use screws with screw holes being provided in the rim, but the disc 21 had advantages that will be seen. The disc 21, or other suitable means, is then used to secure the base 13 to a suitable countertop 24, or other horizontal surface. Use of adhesive makes it possible to adhere it to any countertop whether of wood, plastic, formica, tile porcelain, or metal, without drilling any screw holes. In any event, the base 13** is then held stationary.

The upper rotatable plastic member 14 has an annular flat rim 25 about 1/10 inch thick and a central protrusion 26 which is preferably frustoconical to match the frustoconical protrusion 16, but, if desired, only the outer surface 27 of the protrusion 26 may be frustoconical. It preferably extends about 3 inches high and about 1/10 inch thick and has a gradation in diameter which may be from about 1.5 inch at the bottom to about 1.4 inch at the top. This is an angle of about 1° or 2°, e.g., 1°20′, but the angle may also be smaller than 1°. It may even be substantially cylindrical, the frustoconical shape, in this instance, being largely for molding convenience and to match with the base member 13.

Near but below the upper end 28 of the protrusion 26 are three core-engaging members 30, each an integral part of the protrusion 26 and connected to it by a springy web 31. Radially inwardly from each of the members 30 is an opening 32 somewhat larger in area than the member 30, so that these members 30 can be urged inwardly as a core 12 is installed over and around them. The rotatable member 14 is molded with the members 30 extending outwardly from the surface 27, so that they tend to engage and retain the core 12. The members 30 may be like buttons or bubbles and may be generally tear shaped. They may be about ½″ below the upper end 28 and about ¾″ high and about ½″ wide at the widest. They resist the relative movement of the core 12 just enough to hold the core firmly when installation is completed, so that the towel may be easily removed. The rolls 11 may, as a result of this construction, always be installed so that they rest against the rim 25.

When assembled, the upper surface 17 of the rim 15 engages a lower surface 34 of the rim 25, while the outer surface 18 of the protrusion 16 engages an inner surface 35 of the protrusion 26. These engaging surfaces 17, 34 and 18, 35 may be smooth but not slippery. A circular rib may be present on one or more similar surfaces, but is not necessary, so long as good rotation and good braking action are assured, as they are by smooth, unslippery surfaces.

Both protrusions 16 and 26 may have solid upper ends 36 and 28 respectively. Preferably, they are slightly domed, as shown, and may, for molding convenience be shaped to provide a central dimple 37 or 38.

It will be evident that the device of this invention is readily installed and that the rotatable member 14 is also freely removable from the base member 13. This need not always be the case, but it is convenient. In this way, it may be removed for installation of a new paper towel roll 11 or for removing an old one, or the core 12 of an exhausted roll 11 may be simply pulled off the device or stripped from it in any suitable way and the new one placed on it. Usually with a slight push being sufficient to assure full seizure.

Once the paper roll is installed vertically, towels are usually removed, either one at a time or as a series, and the same thing applies to bathroom tissues. The roll 11 is held against rotation relative to the member 14 by installing its core 12 around the protrusion 26 until the roll 11 rests against the rim 26 and seized by the members 30. When the member 14 is then reinstalled in the member 13, pulling a towel will cause the upper member 14 (and its roll 11) to rotate relatively to the base member 13, while there is sufficient braking action, so that a towel may be torn off the roll 11 without causing the member 14 and roll 11 to continue rotation and unwind unwanted towels.

Figure 7:
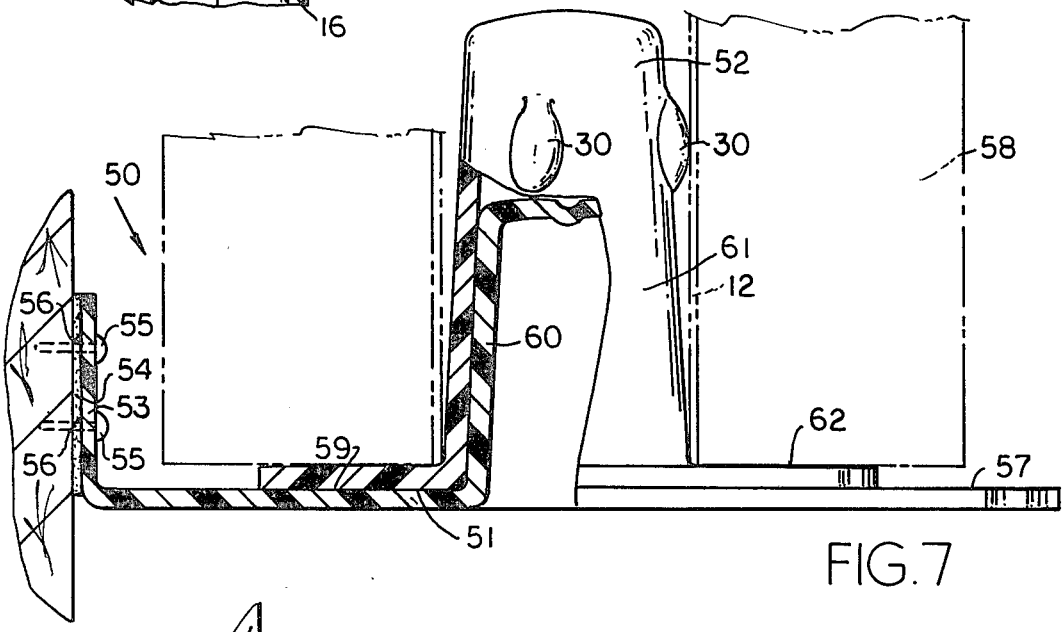
FIG. 7 is a view like FIG. 5, but with installation completed, modified assemby embodying the principles of the invention, shown attached to a wall.
Figure 8:
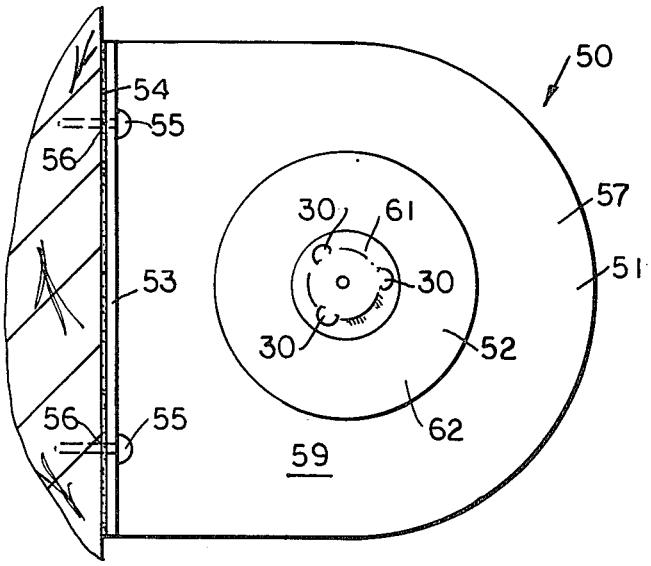
FIG. 8 is a plan view on a smaller scale of the assembly of FIG. 6, with a portion of a house wall shown in section.
Figure 9:
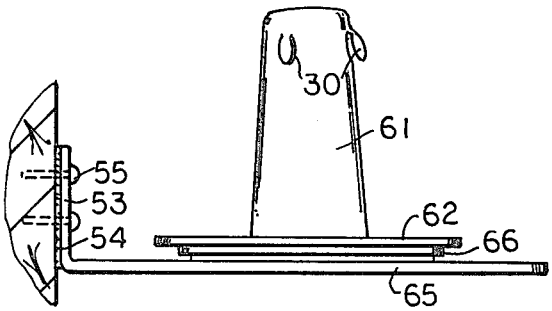
FIG. 9 is a view in side elevation of an assembly basically like that of FIGS. 7 and 8, with a portion of the supporting house wall shown in section, but made in three pieces instead of two.

The Embodiments of FIGS. 7 to 9:

On occasions, countertop space is not available, and yet it is possible to provide a device having most of the advantages of the invention but suitable for wall mounting. FIGS. 7–9 show such applications of the invention. Again, an assembly 50 may be made in two main pieces, as shown in FIGS. 7 and 8, both of which may be molded plastic, such as high-impact polystyrene. In this instance, the assembly 50 comprises a base member 51 and an upper rotatable member 52.

The base member 51 includes a vertically-extending flange 53 which may be attached either by adhesive 54 or by screws 55 (FIG. 9) or by both (FIG. 7), the screws 55 extending through openings 56 provided in the vertical flange 53. The flange 53 is molded integrally with the remainder of the base 51 which also provides a shelf-like portion 57, much wider than the base heretofore discussed, since such a base will have to accommodate the full outside width of a paper roll 58 (See FIG. 7). It is, therefore, made large and may be, for example, 6½ inches in diameter. This acts, then, to form its own shelf. The base 51, in the form of the invention shown in FIGS. 7 and 8, 9 has an upper surface 59, and a projection 60 which is frustoconical and preferably about 2½ inches high.

The rotatable member or spindle 52 goes over the projection 60 and supports the roll 58, as heretofore. It may be substantially exactly like the rotatable member 14, having a protrusion 61 with the members 30 and a disc-like bottom portion 62. Operation, so far as the part between the stationary base 51 and the rotatable spindle 52 are concerned, is that already described. If desired, the protrusion 60 from the base 51 may be placed off-center, for the outer portion of the roll 58 may need no extensive support.

If desired, as shown in FIG. 9, the base 51 may be made in two pieces, with a shelf member 65 integral with the flange 53, and a separate base member 66 adhesively secured thereto and substantially like the bases previously described.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A two-piece paper towel roll holder, including in combination:

a stationary base member of high-impact plastic having an annular rim surrounding a central hollow projection, said rim having an upper surface on the same side as said projection, a rotatable member of high-impact plastic having an annular rim surrounding a central hollow projection that nests around the outer surface of the hollow projection of said base member in surface engagement therewith and is rotatable with respect thereto, said rim having a lower surface facing the upper surface of said base member's rim, said projection of said rotatable member having a series of integral, yieldable, outwardly extending retention members, for firmly and non-rotatably engaging the hollow core of a paper towel roll, said retention members being connected to the remainder of said projection only by a springy web, a said projection having an opening radially inwardly from each said retention member, whereby said base member can be secured to a stationary supporting surface and said rotatable member is rotatable about said base member.

2. The holder of claim 1 wherein said base member has a vertical flange extending up from one side of said rim, said flange having associated therewith, means for securing said flange to a vertical surface.

3. The paper towel roll holder of claim 1 wherein said rim of said stationary base member has an adhesive-receptive surface of its other side, said protrusion having an outer surface, and adhesive material adhered to said adhesive-receptive surface and able to adhere to a countertop.

4. The holder of claim 3 wherein said rim of said base member has a depending circumferential lip at its outer edge, said adhesive material being within the area encircled by said lip.

5. The holder of claim 4 wherein the adhesive material is a plastic foam disc slightly thicker than said lip and having strong adhesive on both faces.

6. The holder of claim 1 wherein said upper surface of said base member's rim and said lower surface of said rotatable member's rim are smooth but not slippery, to provide for rotation with braking action.

7. The holder of claim 6 wherein the outer surface of said base member's projection and the inner surface of said rotatable member's protrusion are smooth but not slippery, to provide for rotation with braking action.

8. The holder of claim 1 wherein there is a shelf member having a vertical flange for attachment to a vertical surface, said base member being secured to said shelf member.

9. The holder of claim 8 having a sheet of plastic foam with an upper surface adhesively secured to the lower surface of said base member and an exposed adhesive layer secured to the lower surface of said sheet.

* * * * *